United States Patent [19]

Lombardo

[11] Patent Number: 4,930,738

[45] Date of Patent: Jun. 5, 1990

[54] PORTABLE SUPPORT BRACKET

[76] Inventor: John Lombardo, P.O. Box 874, Kirkland, Wash. 98083-0874

[21] Appl. No.: 393,570

[22] Filed: Aug. 14, 1989

[51] Int. Cl.[5] ..... A47G 29/00

[52] U.S. Cl. ..... 248/205.1; 248/289.1; 248/220.2

[58] Field of Search ..... 248/205.1, 290, 289.1, 248/220.2; 16/381, 387, 251, 261–264

[56] References Cited

U.S. PATENT DOCUMENTS

| | | | |
|---|---|---|---|
| 437,486 | 9/1890 | Driesbach | 248/290 X |
| 1,475,025 | 11/1923 | Newman et al. | 248/289.1 X |
| 1,751,691 | 3/1930 | Flath . | |
| 2,512,397 | 6/1950 | Trautner | 248/205 |
| 2,895,698 | 7/1959 | Palmer | 248/205 |
| 2,896,791 | 11/1959 | Raber | 211/86 |
| 2,926,382 | 3/1960 | Knese et al. | 16/261 |
| 2,982,508 | 5/1961 | Larsen et al. | 248/205.1 |
| 3,007,193 | 11/1961 | Hughes et al. | 16/263 X |
| 3,805,325 | 4/1974 | Lee | 16/262 |
| 4,629,265 | 12/1986 | Chester | 16/263 X |

*Primary Examiner*—Alvin C. Chin-Shue

[57] ABSTRACT

The invention discloses a portable support bracket that is detachably mounted to the intermeshing sleeves of a door hinge without removing the hinge pin from the door hinge. The invention is functional on right or left side hinged doors and on the upper and lower hinge of a common door to provide connection and support for custom framework or other items.

The invention includes a first member and a second member. The first member comprises a vertical base, two arms and a flange. The arms are aligned in parallel relation extending from opposite ends of the vertical base and spaced to simultaneously mount above and below the intermeshing sleeves of a door hinge. Each arm contains a slot capable of accepting the shaft of a hinge pin. The flange extends from one side of, and perpendicular to the vertical base and is extended in the opposite direction to the arms. The second member comprises, a vertical base and two arms that extend from opposite ends of the vertical base, aligned in parallel relation and spaced to simultaneously mount above and below the arms of the first member. One arm contains a slot capable of accepting the shaft of a hinge pin, the remaining arm contains a threaded aperture with a diameter similar to that of a hinge pin.

1 Claim, 1 Drawing Sheet

PORTABLE SUPPORT BRACKET

BACKGROUND—FIELD OF INVENTION

The present invention relates to supports for being detachably mounted upon a door hinge of the type comprising, two leaves joined through intermeshed sleeves held together by a hinge pin.

BACKGROUND—DESCRIPTION OF PRIOR ART

Many occupants of homes, apartments and offices find it necessary to attach items such as full length mirrors, hooks and racks of various styles directly to a door. The item will usually be attached to the door with screws or similar fasteners. Many interior doors are constructed with a hollow core that will not successfully support screws or similar fasteners. In addition, it is undesirable to put a hole in a door regardless of its structure because the hole detracts from its beauty and is costly to repair.

The present invention was developed to conveniently attach to a door hinge, thereby providing connection and support for many items that would otherwise be attached directly to a door or wall with screws or fasteners, eliminating holes therein and costly repairs.

Heretofore a few devices have been developed to attach to the hinge of a door. One type of device has a hook or plurality of hooks that extend outwardly from the attached door hinge. Another type of device has an elongated member extending outwardly from the attached door hinge. These devices were primarily designed to support clothing and cannot be used in the manner of the present invention.

SUMMARY OF THE INVENTION

Accordingly the primary object of the present invention is to provide a support bracket to be detachably mounted upon a door hinge to provide connection and support for custom framework or other items such as full length mirrors, hooks and racks of various styles, to avoid attaching them directly to a door or wall with screws or the like.

Another primary object of the present invention is to provide a support bracket to be detachably mounted upon a door hinge without removing the hinge pin from the door hinge.

Another object of the present invention is to provide a support bracket to be detachably mounted upon the upper and lower hinge of a common door to provide connection and support for custom framework or other items that will span the upper and lower hinge.

A further object of the present invention is to provide a support bracket to be detachably mounted upon a door hinge that can be utilized by an individual at home or work.

A further object of the present invention is to provide a support bracket to be detachably mounted upon a door hinge that is operational on the right or left side of a door.

Further objects and advantages of the present invention will become apparent from a consideration of the drawings and ensuing description of it.

DESCRIPTION OF THE PREFERRED EMBODIMENT

Figure 1:
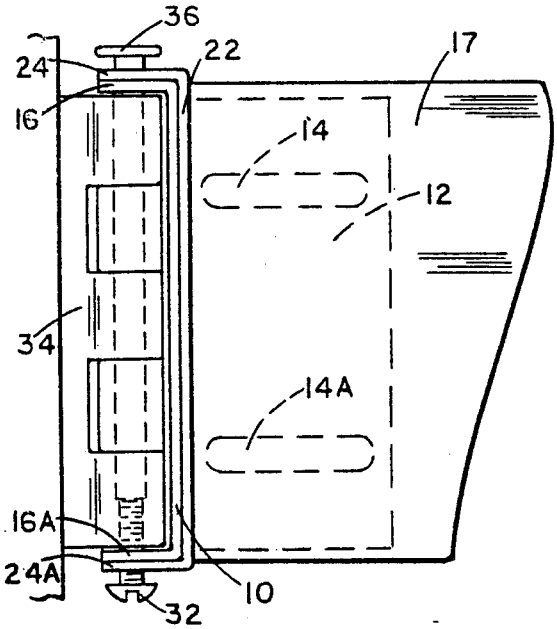
FIG. 1 is a side elevation view illustrating the present invention mounted to the intermeshing sleeves of a door hinge and an example of framework.

Referring to FIGS. 1–4 of the drawings the present invention, broadly indicated by numeral 6, is preferably formed from metal such as brass comprising, a first member 8 and a second member 20.

First member 8 comprises, a vertical base 10, a flange 12 and arms 16 and 16A.

Figure 2:
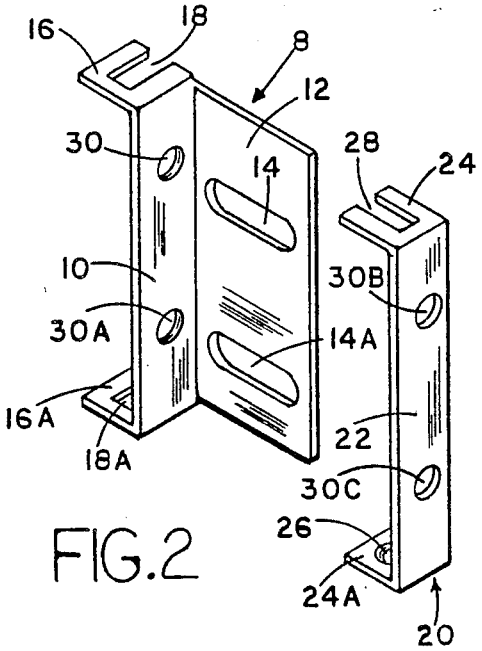
FIG. 2 is a perspective view illustrating the second member and the first member in their unconnected condition.
Figure 4:
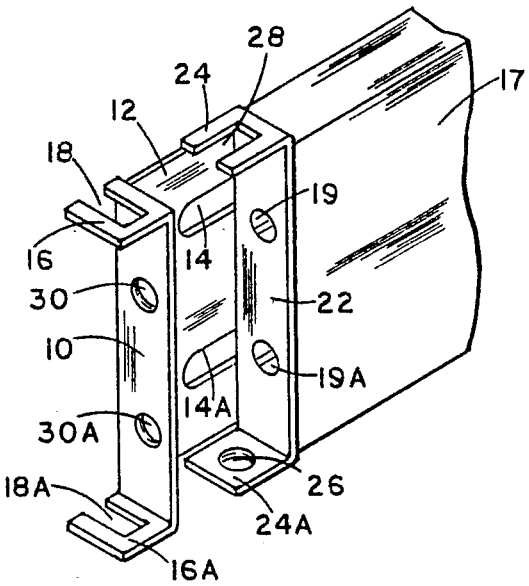
FIG. 4 is a perspective view illustrating the first member and the L-shaped member connected in sliding engagement to an example of framework.

Vertical base is rectangular in shape and has a height approximately equal to the height of door hinge 34, a width larger than the outside diameter of the intermeshing sleeve of the intermeshing sleeves of door hinge 34 and contains threaded apertures 30 and 30A therethrough, best seen in FIGS. 2 and 4.

Figure 3:
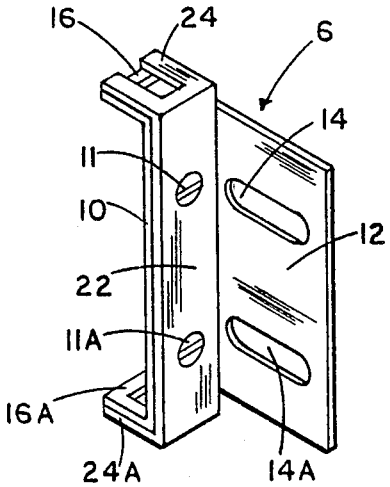
FIG. 3 is a perspective view illustrating the second member and the first member in their connected condition.

Threaded apertures 30 and 30A are spaced along the vertical centerline of vertical base 10 and of sufficient diameter to receive screws 11 and 11A therethrough to facilitate the detachable connection of second member 20 to first member 8, best seen in FIGS. 2 and 3.

Arms 16 and 16A extend from opposite ends of, and perpendicular to vertical base 10, spaced in parallel relation and separated by sufficient distance to simultaneously mount above and below the intermeshing sleeves of door hinge 34, best seen in FIG. 1, and contain slots 18 and 18A respectively.

Slots 18 and 18A are aligned on center therethrough arms 16 and 16A, sized to receive the shaft of hinge pin 36 therethrough, and slidewardly opening best seen in FIG. 4.

Flange 12 is rectangular in shape extending from one side of, and perpendicular to vertical base 10, extending in the opposite direction to arms 16 and 16A and contains oblong apertures 14 and 14A therethrough, best seen in FIGS. 2 and 3.

Figure 5:
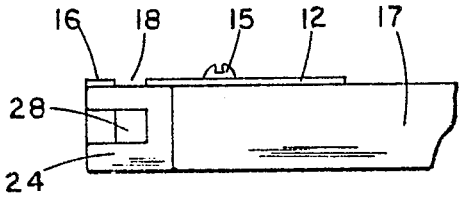
FIG. 5 is a top view illustrating the second member and the first member in their final interconnected condition with an example of framework.

Oblong apertures 14 and 14A extend along the width of flange 12, aligned in parallel relation and sized to receive screws 15 (one not shown) therethrough to facilitate the detachable connection of first member 8 to framework 17 or other items, best seen in FIGS. 4 and 5.

Referring again to FIGS. 1–4 of the drawings second member 20 comprises, a vertical base 22 and arms 24 and 24A.

Arms 24 and 24A extend from opposite ends of, and perpendicular to vertical base 22, spaced in parallel relation and separated by sufficient distance to simultaneously mount above and below arms 16 and 16A of first member 8, best seen in FIGS. 1 and 3. Arms 24 and 24A contain slot 28 and threaded aperture 26, respectively.

Vertical base 22 is rectangular in shape and contains bores 30B and 30C therethrough, spaced along the vertical centerline to register with threaded apertures 30 and 30A of vertical base 10 and of a sufficient diameter to receive screws 11 and 11A therethrough to facilitate the detachable connection of second member 20 to first member 8, best seen in FIG. 3, or to receive screws 19 and 19A therethrough to facilitate the detachable connection of second member 20 to framework 17, best seen in FIG. 4.

Slot 28 is aligned on center therethrough arm 24, sized to receive the shaft of hinge pin 36 therethrough, and forwardly opening.

Threaded aperture 26 is aligned on center therethrough arm 24A and of a diameter similar to hinge pin 36 to receive screw 32 therethrough, best seen in FIGS. 1 and 4.

Screw 32 is sized and threaded to correspond with aperture 26 and is a sufficient length to be insertable inside the intermeshing sleeves of door hinge 34, best seen in FIG. 1.

OPERATION OF THE INVENTION

Present invention 6 is conveniently mounted to the intermeshing sleeves of door hinge 34 without removing hinge pin 36 from door hinge 34. The following description will demonstrate second member 20 being detachably connected to first member 8.

Referring to FIGS. 1, 3, and 5 of the drawings, slightly raise hinge pin 36. Mount arms 16 and 16A of first member 8 above and below the intermeshing sleeves of door hinge 34 and slide slot 18 or 18A around the shaft of hinge pin 36, accordingly. Mount second member 20 over second member 8, keeping arm 24 upwardly, and slide slot 28 around the shaft of hinge pin 36. Insert screws 11 and 11A through bores 30B and 30C of second member 20 and into threaded apertures 30 and 30A of first member 8, best seen in FIG. 3. Insert screw 32 through threaded aperture 26 and inside the intermeshing sleeves of door hinge 34, best seen in FIG. 1. Connect framework 17 to flange 12 by inserting screws 15 (one not shown) through oblong aperture 14 and 14A and into framework 17, best seen in FIG. 5.

Referring now to FIGS. 1, 4 and 5 of the drawings, the following description will demonstrate second member 20 being detachably connected to framework 17. Mount second member 20 to framework 17, keeping arm 24 upwardly, and insert screws 19 and 19A through bores 30B and 30C and into framework 17, best seen in FIG. 4. Align first member 8 with second member 20 and insert screws 15 (one not shown) forward of the midpoint of apertures 14 and 14A, best seen in FIG. 5. First member 8 and second member 20 and framework 17 are now connected in sliding engagement, best seen in FIG. 4. Slightly raise hinge pin 36. Mount arms 16 and 16A of second member 8 above and below the intermeshing sleeves of door hinge 34 and slide slot 18 or 18A around the shaft of hinge pin 36, accordingly. Mount second member 20 over first member 8 and slide slot 28 around the shaft of hinge pin 36. Tighten screws 15. Insert screw 32 through threaded aperture 26 and inside the intermeshing sleeves of door hinge 34, best seen in FIG. 1.

Thus, present invention 6 will be found useful to provide connection and support for custom framework, full length mirrors, hooks and racks of various styles to avoid attaching them directly to a door or wall with screws or the like, eliminating holes therein the surface of a door and costly repairs.

While the above description contains many specificities, these should not be construed as limitations, but rather as an exemplification of the preferred embodiment thereof. There are possible variations. For example those skilled in the art will be able to change the dimensions to fit any size hinge. They can change the size and shape of flange 12. They can add another flange in parallel relation to flange 12. They can use alternative materials such as sheet metal, aluminum, or casting.

Accordingly the scope of the invention should be determined not by the embodiment illustrated, but by the appended claims and their legal equivalents.

Having described the present invention, I claim:

1. A portable support bracket adapted to be detachably mounted upon a door hinge of the type having intermeshing sleeves held together by a hinge pin comprising:

(a) a first member constructed from rigid material to form a first vertical base, said first vertical base is substantially rectangular in shape and, a first pair of parallel arms, one each of said arms extending from opposite ends of, and perpendicular to said first vertical base, each said arm of said first member contains a slot therein, said slots being aligned on center, sidewardly opening, and sized to receive the shaft of said hinge pin therethrough, said arms of said first member are separated by sufficient distance to simultaneously mount above and below said intermeshing sleeves of said door hinge and, a flange, said flange being substantially rectangular in shape, extending from one side of, and perpendicular to said first vertical base, said flange extends in the opposite direction to said first pair of parallel arms and;

(b) a second member constructed from rigid material to form a second vertical base, said second vertical base is substantially rectangular in shape and, a second pair of parallel arms, one each of said second pair of parallel arms extending from opposite ends of, and perpendicular to said second vertical base, one said arm of said second member contains a slot therein, said slot being aligned on center, forwardly opening and sized to receive said shaft of said hinge pin therethrough, the remaining said arm contains a centered threaded aperture therein, said second pair of parallel arms are separated by sufficient distance to simultaneously mount above and below said first pair of parallel arms of said first member;

(c) said second member being detachably mounted over said first member with said first pair of parallel arms therebetween said second pair of parallel arms. and the slot opening of an arm of said first member being orthogonal with the slot opening of the second member.

* * * * *